US012025125B2

(12) United States Patent
Hu et al.

(10) Patent No.: US 12,025,125 B2
(45) Date of Patent: Jul. 2, 2024

(54) SCROLL COMPRESSOR HAVING SEALED-OIL INTERCEPTION STRUCTURE

(71) Applicant: Copeland Climate Technologies (Suzhou) Co. Ltd., Jiangsu (CN)

(72) Inventors: Xiaowei Hu, Suzhou (CN); Lingfeng Ni, Suzhou (CN)

(73) Assignee: Copeland Climate Technologies (Suzhou) Co. Ltd., Jiangsu (CN)

( * ) Notice: Subject to any disclaimer, the term of this patent is extended or adjusted under 35 U.S.C. 154(b) by 402 days.

(21) Appl. No.: 17/298,473

(22) PCT Filed: Oct. 31, 2019

(86) PCT No.: PCT/CN2019/114652
§ 371 (c)(1),
(2) Date: Dec. 23, 2021

(87) PCT Pub. No.: WO2020/108224
PCT Pub. Date: Jun. 4, 2020

(65) Prior Publication Data

US 2022/0136508 A1 May 5, 2022

(30) Foreign Application Priority Data

Nov. 29, 2018 (CN) ..... 201811443483.7
Nov. 29, 2018 (CN) ..... 201821990326.3

(51) Int. Cl.
*F04C 18/02* (2006.01)
*F04C 27/00* (2006.01)
(Continued)

(52) U.S. Cl.
CPC ..... *F04C 18/0215* (2013.01); *F04C 27/008* (2013.01); *F04C 28/26* (2013.01);
(Continued)

(58) Field of Classification Search
CPC .... F04C 18/0215; F04C 27/008; F04C 28/26; F04C 29/0092; F04C 29/026; F04C 29/06; F04C 29/065
See application file for complete search history.

(56) References Cited

U.S. PATENT DOCUMENTS 4,958,993 A * 9/1990 Fujio ..... F04C 18/0215 418/55.6
6,309,198 B1 * 10/2001 Zamudio ..... F04C 29/026 418/55.6
(Continued)

FOREIGN PATENT DOCUMENTS

CN 1749568 A 3/2006
CN 104662199 A 5/2015
(Continued)

OTHER PUBLICATIONS

International Search Report (English and Chinese) and Written Opinion (Chinese) of the International Searching Authority issued in PCT/CN2019/114652, dated Feb. 5, 2020; ISA/CN (10 pages).

*Primary Examiner* — Mary Davis
(74) *Attorney, Agent, or Firm* — Harness, Dickey & Pierce, P.L.C.

(57) ABSTRACT

A scroll compressor having a sealed-oil interception structure, comprising: a partition plate unit which has an orifice, and a first sealing surface located at a bottom side of the partition plate unit and surrounding the orifice; a sealing assembly which is arranged below the partition plate unit and comprises a second sealing surface configured to surround a center hole of the sealing assembly, wherein the second sealing surface abuts against the first sealing surface to form a seal that separates a high-pressure side from a low-pressure side; and an oil interception device provided at the orifice of the partition plate unit. The present compressor may re-introduce a part of lubricating oil to an inner part of
(Continued)

a scroll and/or to a low-pressure oil pool side, thereby improving the compression performance and operating stability of the compressor, and reducing the oil circulation rate.

18 Claims, 11 Drawing Sheets

(51) Int. Cl.

| | |
|---|---|
| ***F04C 28/26*** | (2006.01) |
| ***F04C 29/00*** | (2006.01) |
| ***F04C 29/02*** | (2006.01) |
| ***F04C 29/06*** | (2006.01) |

(52) U.S. Cl.
CPC ..... *F04C 29/0092* (2013.01); *F04C 29/026* (2013.01); *F04C 29/06* (2013.01); *F04C 29/065* (2013.01)

(56) References Cited

U.S. PATENT DOCUMENTS

| | | | | |
|---|---|---|---|---|
| 7,862,313 | B2 * | 1/2011 | Hwang | F04C 18/0215 418/55.6 |
| 9,121,276 | B2 | 9/2015 | Heidecker et al. | |
| 9,605,677 | B2 | 3/2017 | Heidecker et al. | |
| 2006/0057012 | A1 | 3/2006 | Park et al. | |
| 2014/0023540 | A1 | 1/2014 | Heidecker et al. | |
| 2014/0023541 | A1 | 1/2014 | Heidecker et al. | |
| 2014/0024563 | A1 | 1/2014 | Heidecker et al. | |
| 2015/0110660 | A1 | 4/2015 | Ma | |
| 2017/0182561 | A1 * | 6/2017 | Scancarello | B22F 10/28 |
| 2018/0223842 | A1 * | 8/2018 | Stover | F04C 29/0085 |
| 2018/0328364 | A1 * | 11/2018 | Kim | F04C 29/026 |

FOREIGN PATENT DOCUMENTS

| | | | |
|---|---|---|---|
| CN | 104662300 | A | 5/2015 |
| CN | 207568834 | U | 7/2018 |
| CN | 209180006 | U | 7/2019 |

* cited by examiner

SCROLL COMPRESSOR HAVING SEALED-OIL INTERCEPTION STRUCTURE

This application is the national phase of International Application No. PCT/CN2019/114652 titled "SCROLL COMPRESSOR HAVING SEALED-OIL INTERCEPTION STRUCTURE" and filed on Oct. 31, 2019, which claims the benefit of priorities to the following two Chinese patent applications, both of which are incorporated herein by reference:

1) Chinese Patent Application No. 201811443483.7, titled "SCROLL COMPRESSOR HAVING SEALED-OIL INTERCEPTION STRUCTURE", filed with the China National Intellectual Property Administration on Nov. 29, 2018; and
2) Chinese Patent Application No. 201821990326.3, titled "SCROLL COMPRESSOR HAVING SEALED-OIL INTERCEPTION STRUCTURE", filed with the China National Intellectual Property Administration on Nov. 29, 2018.

FIELD

The present application relates to a scroll compressor having a sealed-oil interception structure.

BACKGROUND

The content herein only provides background information related to the present disclosure, which may not constitute prior art.

A scroll compressor generally includes a compressor mechanism composed of a fixed scroll component and an orbiting scroll component. The compressor mechanism is used to compress working fluid from a low-pressure side into a high-pressure state and discharge the working fluid to an external circulation pipeline through an exhaust fitting on the high-pressure side. Generally, lubricant in the compressor forms droplets or mist due to the movement of various movable components in the compressor and is mixed in the working fluid. These lubricant droplets or mist mixed in the working fluid are sucked from a suction port on the low-pressure side into a series of compression chambers defined by the fixed scroll component and the orbiting scroll component to play the roles of lubrication, sealing and cooling, etc. Finally, the working fluid mixed with the lubricant is compressed into the high-pressure state (gaseous mixture) by the scroll assembly, and then enters the external circulation pipeline outside a housing of the compressor through the exhaust fitting on the high-pressure side.

In order to ensure the compression performance of the compressor, a partition plate which separates an internal space of the compressor into a high-pressure side and a low-pressure side and a corresponding sealing assembly are provided inside the compressor. The sealing assembly is arranged in a recess portion on an end plate of the fixed scroll component. The sealing assembly (especially a floating sealing assembly) includes an upper plate, a lower plate and a sealing member arranged between the upper plate and the lower plate. A top end of the upper plate can be sealed against a collar on the partition plate or directly seal against a lower surface of the partition plate to achieve effective separation between the high-pressure side and the low-pressure side. However, in this field, there is still room and demand for reducing oil circulation of a system, improving the lubrication of a scroll structure, and improving the sealing performance and wear condition between the sealing assembly and the partition plate (or the collar of the partition plate).

SUMMARY

An object of the present application is to provide a scroll compressor capable of performing additional lubrication and sealing for an interior of the scroll.

Another object of the present application is to provide a sealed-oil interception structure for a scroll compressor capable of improving the sealing performance of a metal-mental seal between a sealing ring and a partition plate.

Another object of the present application is to provide a sealed-oil interception structure for a scroll compressor capable of reducing the wear of a metal-mental seal surface between a sealing ring and a partition plate.

Another object of the present application is to provide a scroll compressor which is capable of facilitating the management of lubricating oil of the compressor.

According to one aspect of the present application, a scroll compressor is provided, which includes: a partition plate unit that has an exhaust hole for allowing exhaust gas to pass therethrough and a first sealing surface located on a bottom side of the partition plate unit; and a sealing assembly that is arranged below the partition plate unit and includes at its top end a second sealing surface configured to surround a central hole of the sealing assembly, and the second sealing surface abuts against the first sealing surface so that a sealing portion is formed which separates a high-pressure side and a low-pressure side. The scroll compressor further includes an oil interception device arranged at the exhaust hole of the partition plate unit to intercept oil in the exhaust gas and allow the intercepted oil to flow back through the partition plate unit.

Optionally, the partition plate unit includes a partition plate defining the exhaust hole and a wear-resistant gasket provided on a bottom side of the partition plate and around the exhaust hole, and a bottom surface of the wear-resistant gasket provides the first sealing surface.

Optionally, the partition plate unit includes a partition plate having a central hole and an additional device mounted in the central hole of the partition plate, and the additional device defines the exhaust hole of the partition plate and the first sealing surface.

Optionally, the additional device is a sealing ring, a central orifice of the sealing ring defines the exhaust hole of the partition plate unit, and a bottom surface of the sealing ring provides the first sealing surface.

Further, the additional device includes a sealing ring and a cylindrical body formed integrally or separately with the sealing ring, the cylindrical body extends upward around a central orifice of the sealing ring, and the cylindrical body is provided with at least one hole serving as the exhaust hole of the partition plate unit, and a bottom surface of the sealing ring provides the first sealing surface.

Optionally, the oil interception device is arranged in the cylindrical body in a manner of crossing an inner diameter of the cylindrical body to intercept the oil in the exhaust gas to be discharged through the at least one hole at the cylindrical body.

Alternatively, the oil interception device integrally surrounds an outer side of the cylindrical body above the sealing ring.

Optionally, the at least one hole is provided at a side wall of the cylindrical body. The oil interception device is in a split form and separately arranged in the at least one hole on the cylindrical body.

Preferably, the top end of the sealing assembly extends inward radially beyond a wall surface of a central passage of the partition plate unit, and an inner edge of the top end is provided with a protruding portion protruding upward at a radially inner side of the central passage of the partition plate unit, wherein a gap is left between the protruding portion and the wall surface of the central passage to receive at least a part of the oil dripping from the oil interception device.

According to requirements, at least one oil hole is provided in the sealing ring, the number and the position of the oil hole are set to be suitable for receiving the oil from the oil interception device, and the oil hole is positioned to be located on a radially inner side of the sealing portion in an assembled state.

The oil hole may be a cylindrical through hole, an inverted conical through hole or a through hole with a flared portion at an upper end.

An oil guide groove is provided on the sealing ring, and the oil guide groove is located above the oil hole for receiving the oil dripping from the oil interception device and guiding the oil into the oil hole.

Preferably, the top end of the sealing assembly is provided with a groove located between the second sealing surface and the protruding portion, and the groove is located below the oil hole in the assembled state to receive the oil from the oil hole and the gap.

The cylindrical body may be configured as a silencer cover suitable for reducing exhaust noise.

The oil interception device is a filter device with a filter screen. The filter device may be an integrated filter device which is able to be adapted to have a flat plate shape, a dome shape, a conical shape or a topped cylindrical shape according to the arrangement of the exhaust hole of the partition plate unit. When the partition plate unit has a plurality of exhaust holes, the filter device may also be a split-type filter device separately arranged at the exhaust holes of the partition plate unit.

The oil interception device may be a multi-layer textile fiber screen or a multi-layer metal wire filter screen.

The sealing assembly may be a floating sealing ring assembly arranged in a recess portion at a fixed scroll end plate of the scroll compressor, and the top end is provided by an upper plate of the floating sealing ring assembly.

The first sealing surface and the second surface form a metal-metal seal.

As an advantageous effect, the compressor according to the present application can realize the secondary separation of the lubricating oil/refrigerant mixture after compression, and re-guide the lubricating oil into the interior of the scroll by using the leakage passage to lubricate and seal the interior of the scroll, so as to improve the working performance and the reliability of the scroll.

As another advantageous effect, the compressor according to the present application can also allow a part of the intercepted oil to be re-guided into the low-pressure oil pool side by using the leakage passage which is caused by deformation or relative movement between the metal-metal sealing surfaces, which can further improve the operation stability and compression performance of the compressor. On one hand, the separated oil is guided to the metal-metal sealing surfaces between the sealing ring and the partition plate for oil sealing, so as to improve the sealing performance. On the other hand, the lubricating oil is guided to lubricate the metal-metal sealing surfaces between the sealing ring and the partition plate, so as to reduce the wear caused by the relative movement.

As another advantageous effect, since the oil proportion in the exhaust gas of the compressor is reduced, the oil circulation rate is reduced, which is beneficial to the management of the lubricating oil of the compressor, and is beneficial to improving the application reliability and performance of the system.

BRIEF DESCRIPTION OF THE DRAWINGS

Through the following description with reference to the drawings, the features and advantages of one or several embodiments of the present application will become easier to understand. The drawings described herein are for illustrative purposes and are not intended to limit the scope of the application in any way. The drawings are not drawn to scale and some features may be enlarged or reduced to show details of specific components. In the drawings.

DETAILED DESCRIPTION OF THE EMBODIMENTS

Figure 1:
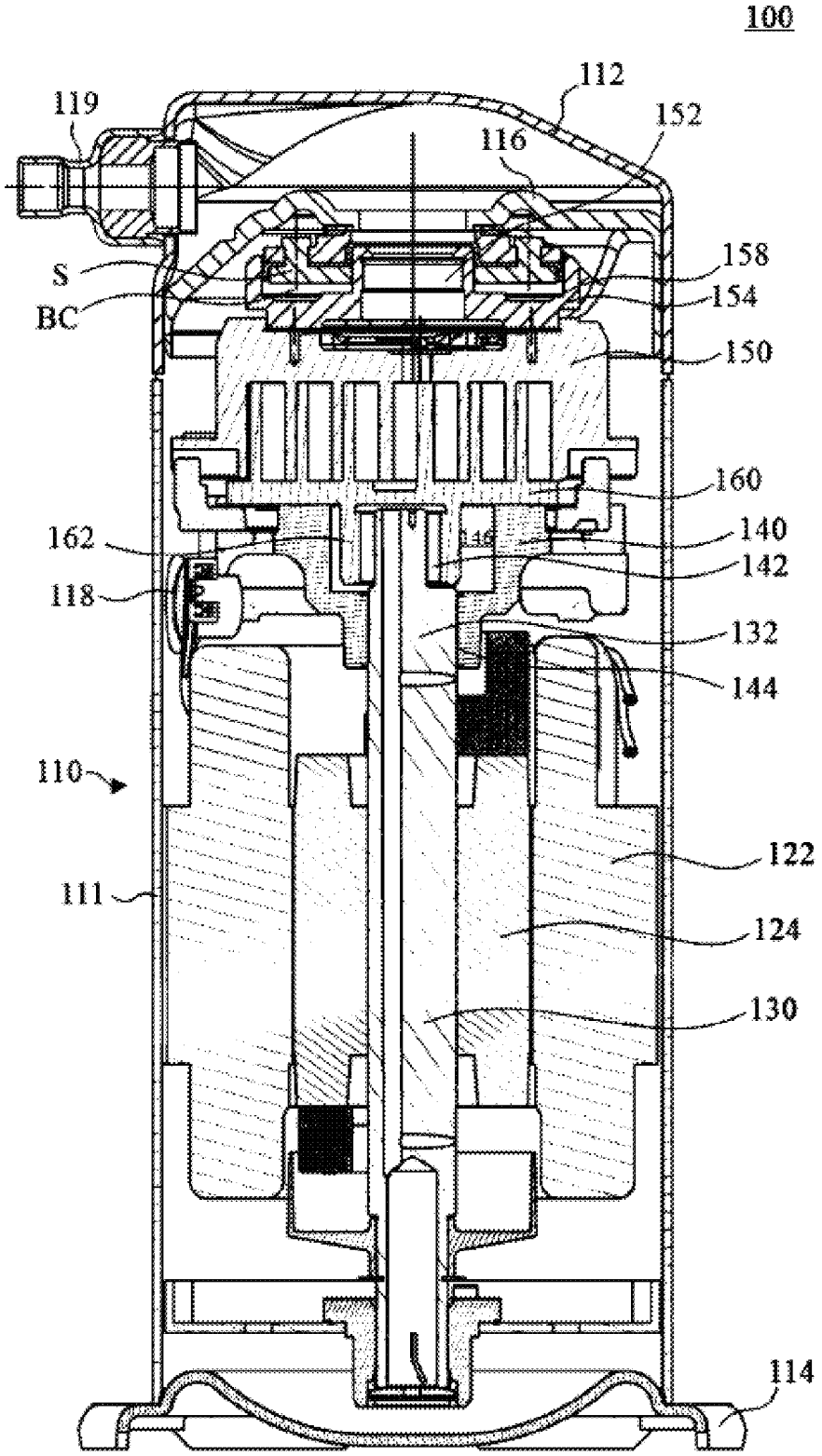
FIG. 1 is a longitudinal sectional view of a conventional scroll compressor.

The following description of various embodiments of the present application is only exemplary, and is by no means a limitation to the present application and application or usage of thereof. The same reference numerals are used in the various drawings to denote the same components, and therefore, the configuration of the same components will not be described repeatedly.

Figure 2A:
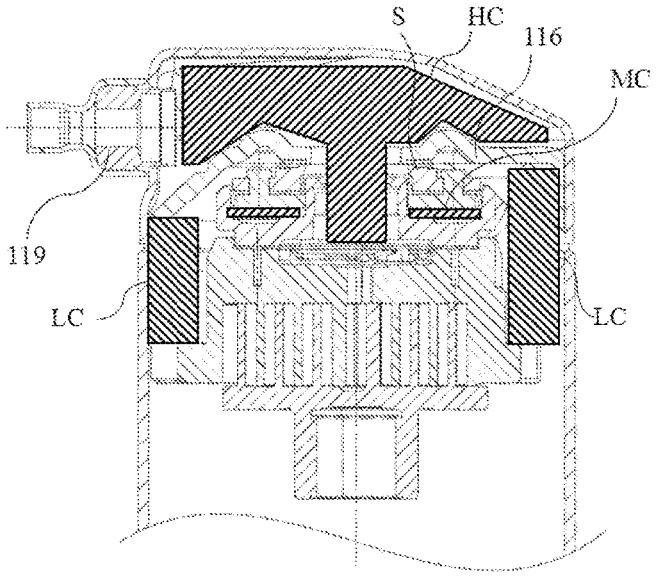
FIG. 2*a* is a longitudinal sectional view schematically showing the pressure distribution in the scroll compressor shown in FIG. 1.

First, the overall configuration and operating principle of a scroll compressor will be described with reference to FIG. 1. As shown in FIG. 1, the scroll compressor 100 (also referred to as a compressor hereinafter sometimes) generally includes a housing 110. The housing 110 may include a substantially cylindrical body 111, a top cover 112 arranged at an upper end of the body 111, a bottom cover 114 located below the body 111 and a partition plate 116 arranged between the top cover 112 and the body 111 to separate an internal space of the compressor into a high-pressure side and a low-pressure side. As schematically shown in FIG. 2*a*, a space between the partition plate 116 and the top cover 112 constitutes the high-pressure side HC, and a space outside a scroll assembly and below the partition plate 116 constitutes the low-pressure side LC. An intake fitting 118 for sucking fluid is provided on the low-pressure side LC, and an exhaust fitting 119 for discharging the compressed fluid is provided on the high-pressure side HC. A motor 120 composed of a stator 122 and a rotor 124 is arranged in the housing. The rotor 124 is provided with a drive shaft 130 to drive a compression mechanism composed of a fixed scroll component 150 and an orbiting scroll component 160. The fixed scroll component 150 includes a split annular member 154 arranged above an end plate for forming a recess portion 158. An exhaust passage 152 is defined on an inner side of the annular member 154. A space of the exhaust passage 152 also constitutes the high-pressure side HC.

In order to achieve fluid compression, an effective sealing is required between the fixed scroll component 150 and the orbiting scroll component 160, and good lubrication is also required between various movable components.

As an important aspect of compressor sealing, generally, a sealing assembly S (for example, a floating sealing ring assembly) is provided in the recess portion 158 of the fixed scroll component 150. That is, the sealing assembly S is arranged between the partition plate 116 and the fixed scroll component 150. The sealing assembly S cooperates with the recess portion 158 to form a back-pressure chamber BC for providing back pressure to the fixed scroll component 150. The pressure in the back-pressure chamber is lower than the pressure in the high-pressure side but higher than the pressure in the low-pressure side, that is, the back-pressure chamber is equivalent to an intermediate zone MC.

Figure 2B:
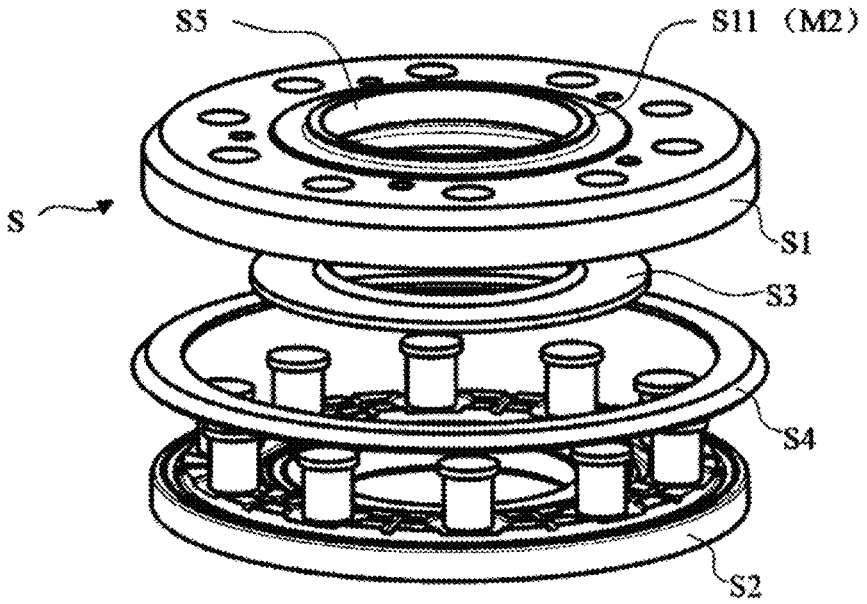
FIG. 2*b* is an exploded view of a double-plate floating sealing ring assembly.
Figure 2C:
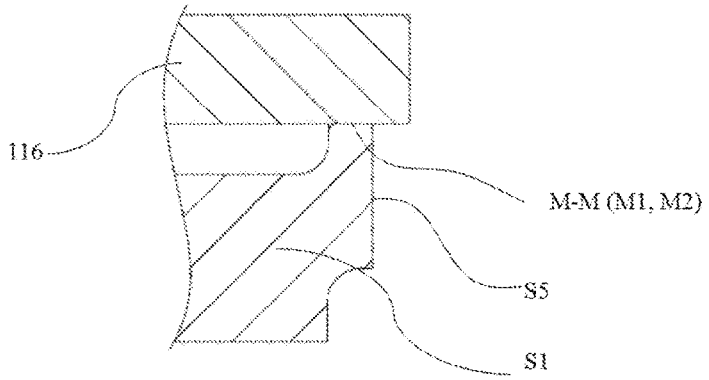
FIG. 2*c* schematically shows a metal-metal sealing portion between a partition plate and a sealing assembly.

As shown in FIG. 2*b*, the sealing assembly S may include an upper plate S1, a lower plate S2 and a first sealing member S3 and a second sealing member S4 which are arranged between the upper plate S1 and the lower plate S2. A shape of the sealing assembly S substantially corresponds to a shape of the recess portion 158, so that the first sealing member S3 can be sealed against a radially inner side wall of the recess portion 158, and the second sealing member S4 can be sealed against a radially outer side wall of the recess portion 158. In addition, a top end S11 of the upper plate S1 may abut against a wear-resistant element (for example, a bottom side of a wear-resistant gasket or a sealing ring as described below) installed on the partition plate 116 or directly abut against a sealing portion of the partition plate 116, so as to realize the sealing, thereby realizing the separation of the high-pressure side and the low-pressure side. FIG. 2*c* schematically shows a metal-metal sealing portion M-M between the top end S11 of the upper plate S1 and the partition plate 116. During the working process of the compressor, there will be a slight relative movement between two sealing surfaces of the metal-mental sealing portion M-M between the upper plate S1 and the partition plate 116 or the wear-resistant element of the partition plate 116, so as to adapt to the slight shaking of the scroll assembly during operation.

In order to ensure that the relative movement between the various components in the compressor proceeds smoothly, it is necessary to provide good lubrication to internal movable elements of the compressor, especially the compression assembly. In the example of the vertical scroll compressor shown in FIG. 1, lubricant (generally lubricating oil) is stored at a bottom of the housing of the compressor. Correspondingly, a passage extending substantially in an axial direction of the drive shaft 130 is formed in the drive shaft 130, that is, a central hole 136 at a lower end of the drive shaft 130 and an eccentric hole 134 extending upward from the central hole 136 to an end surface of an eccentric pin 132 are formed. An end portion of the central hole 136 is immersed in the lubricating oil at the bottom of the housing of the compressor or otherwise supplied with the lubricating oil. During the operation of the compressor, one end of the central hole 136 is supplied with the lubricating oil by an lubricating oil supply device, and the lubricating oil entering the central hole 136 is pumped or thrown into the eccentric hole 134 by centrifugal force during the rotation of the drive shaft 130 and flows upward along the eccentric hole 134 until the lubricating oil reaches the end surface of the eccentric pin 132. The lubricating oil discharged from the end surface of the eccentric pin 132 flows downward along a gap between an unloading bushing 142 and the eccentric pin 132 and a gap between the unloading bushing 142 and a hub 162 to reach a recess portion 146 of a main bearing seat 140. A part of the lubricating oil accumulating in the recess portion 146 flows downward through the main bearing 144, and a part of the lubricating oil is agitated by the hub 162 and moves upward to reach a lower side of an end plate 164 of the orbiting scroll component 160 and spreads between the end plate of the orbiting scroll component 160 and a thrust surface of the main bearing seat 140 with the translational rotation of the orbiting scroll component 160. During the operation of the compressor, the lubricating oil supplied to various movable components in the compressor is thrown out and splashed to form droplets or mist. These lubricating oil droplets or mist may be mixed in the working fluid (mainly refrigerant) sucked from the intake fitting 118. Subsequently, the working fluid mixed with lubricating oil droplets is sucked into a compression chamber between the fixed scroll component 150 and the orbiting scroll component 160, so as to realize the lubrication, sealing and cooling of these scroll components. Finally, the working fluid mixed with lubricating oil is compressed into a high-pressure state (gaseous mixture) by the scroll assembly, and enters an external circulation pipeline outside the housing of the compressor through the exhaust passage 152 and the exhaust fitting 119.

As described above, there is the slight shaking between the partition plate 116 of the compressor and the metal-metal sealing portion M-M of the sealing assembly S, which will inevitably lead to the deformation and wear of the sealing surface. There will be a leakage gap if the metal-metal sealing surface is deformed. The more serious the deformation is, the greater the leakage is, which will in turn lead to the performance degradation of the compressor, especially the performance degradation when the inverter compressor is running at low speed. In addition, the wear of the metal-metal sealing surfaces between the sealing assembly S and the partition plate 116 may also lead to degradation in the sealing performance.

Therefore, the invertor realized that it would be advantageous if the sealing effect of the metal-metal sealing surfaces between the partition plate 116 and the sealing assembly of the existing compressor is improved to reduce the pressure leakage. Furthermore, it would be more advantageous if the metal-metal sealing surfaces between the sealing ring and the partition plate 116 is provided with a lubricating effect so as to reduce the wear of the sealing surfaces.

In addition, the existing solution of the partition plate-floating sealing ring structure has almost no secondary separation of the lubricating oil/refrigerant mixture on the high-pressure side. The lubricating oil mixed in the refrigerant is sucked into the scroll assembly (scroll compression mechanism) and then directly discharged from the compressor, and a system oil circulation is formed. Therefore, the management of a system oil circulation amount is concentrated on the low-pressure side of the compressor, that is, a scroll suction side, and the control of the oil circulation is difficult. Therefore, it is desirable to further improve the control of the oil circulation and reduce the difficulty of controlling the oil circulation.

Based on the above principle and thinking, the inventor proposed an improved sealed-oil interception structure to solve at least one of the above problems. Herein, the "sealed-oil interception structure" is intended to refer to the integrated structure formed by the partition plate structure and the sealing assembly matched with the partition plate structure of the compressor.

The sealed-oil interception structure involved in the present application will now be described with reference to FIGS. 3*a* to 6*b*.

In the present application, the improvement of the sealing assembly S in FIG. 2*b* is mainly in the structure of the upper plate S1. Therefore, the lower plate and the sealing member will not be described in detail herein.

Figure 3A:
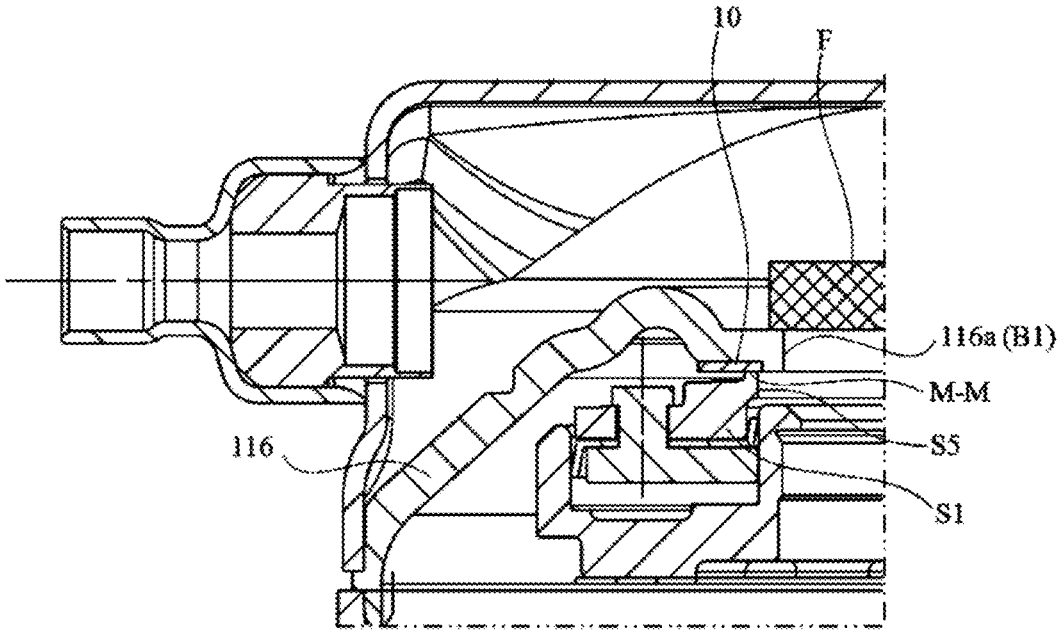
FIG. 3*a* is a partial sectional view of a scroll compressor according to a first embodiment of the present application.

The sealed-oil interception structure according to a first embodiment of the present application will be described in detail below with reference to FIG. 3*a*. The sealed-oil interception structure includes: a partition plate 116, similar to the partition plate shown in FIG. 1, the partition plate 116 defines a central hole 116*a* (in this embodiment, the central hole 116*a* corresponds to a central passage of a partition plate unit B according to the present application, and also corresponds to an exhaust hole B1 of the partition plate unit B) for exhaust gas to pass through, and a wear-resistant gasket 10 is arranged around the central hole 116*a* at a bottom of the partition plate 116 to provide a sealing surface M1 which is more wear-resistant than the partition plate itself (for convenience of distinction, referred to as a first sealing surface M1 hereinafter); a sealing assembly S, the top end S11 of the upper plate S1 (for example, referred to FIG. 2*b*) of the sealing assembly S includes a sealing surface M2 (referred to as a second sealing surface M2 hereinafter) which surrounds a central hole S5 and is configured to abut against the first sealing surface M1 of the partition plate 116 to form an air-tight seal; a filter device F (corresponding to the oil interception device according to the present application) which is mounted above the central hole 116*a* of the partition plate 116 and covers the entire central hole 116*a* (it is understood herein that the filter device F may also be mounted inside the central hole 116*a*, and only covers a part of the central hole 116*a*, as long as the filter device F can intercept a certain amount of oil), so as to filter the lubricating oil in the gaseous mixture discharged from the central hole 116*a*. As described above, these gaseous mixtures are substantially composed of working fluid such as refrigerant and lubricating oil, and at least a part of the lubricating oil in the mixed gas is filtered and stored on the filter device F after the mixed gas is filtered by the filter device F. The oil droplets remaining on the filter device F may drop down or flow downward along a wall surface of the central hole 116*a* of the partition plate 116 into the exhaust passage under the action of gravity, and then flows back to an interior of the scroll through the exhaust passage to lubricate and seal the interior of the scroll, so as to improve the compression performance and reliability of the scroll system. In addition, since the lubricating oil in the exhaust gas is intercepted by the filter device F, the oil proportion in the exhaust gas of the compressor is significantly reduced, which reduces the oil circulation rate. This is beneficial for the management of the lubricating oil of the compressor and the improvement of the application reliability and performance of the system: first, the small oil proportion in the exhaust gas of the compressor is beneficial to improving the energy efficiency (the efficiency of a heat exchanger is higher) of the entire refrigeration/heating cycle; second, the small oil proportion in the exhaust gas of the compressor is beneficial to maintaining an internal oil amount of the compressor and improving the reliability of the compressor operation.

Figure 3B:
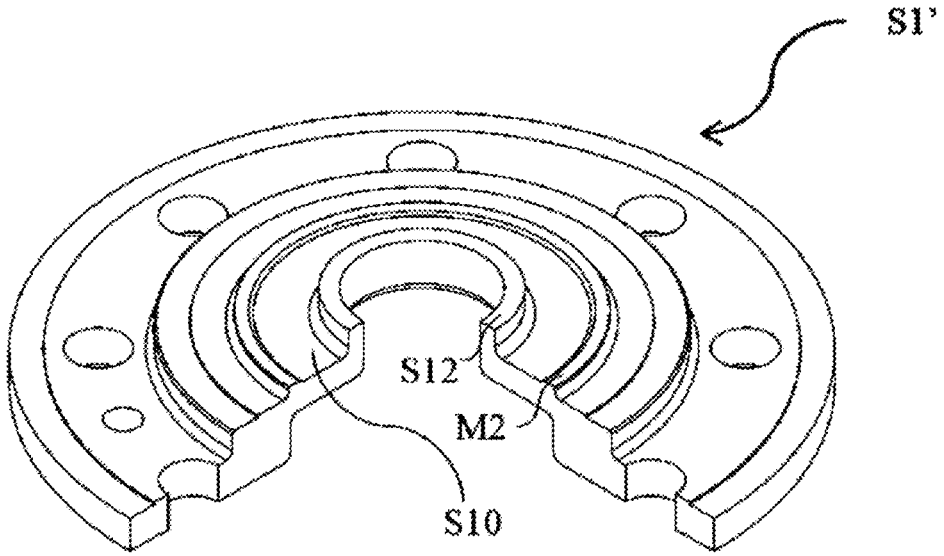
FIG. 3*b* is a sectional perspective view of an upper plate of a sealing assembly with a protruding portion.

As an improved solution, the inventor conceives that the intercepted lubricating oil may be further utilized by slightly changing the structure of the upper plate S1 of the conventional sealing assembly S. As shown in FIG. 3*b*, an improved upper plate S1' is provided. With respect to the upper plate S1, a top end of the upper plate S1' further extends radially inward, until the top end extends beyond a wall surface of the central hole 116*a* (the central passage) of the partition plate 116. An inner edge portion of the upper plate S1' is formed as an annular protruding portion S12 higher than the second sealing surface M2, and a gap is left between the annular protruding portion S12 and the wall surface of the central hole 116*a* of the partition plate 116 in an assembled state. By providing the gap, an annular groove is formed between the annular protruding portion S12 and the partition plate 116, and the annular groove will be functioned as an oil storage groove. Preferably, as shown in FIG. 3*b*, a groove S10 lower than the second sealing surface M2 is provided between the second sealing surface M2 and the annular protruding portion S12. It should be noted that the existence of the groove S10 will facilitate the accumulation of the intercepted lubricating oil on the top end of the upper plate S1', which can better function as an oil storage groove. However, the groove S10 is not absolutely necessary. In some cases, in order to simplify the structure of the upper plate S1' or save the manufacturing cost, the groove S10 may be omitted.

Figure 3C:
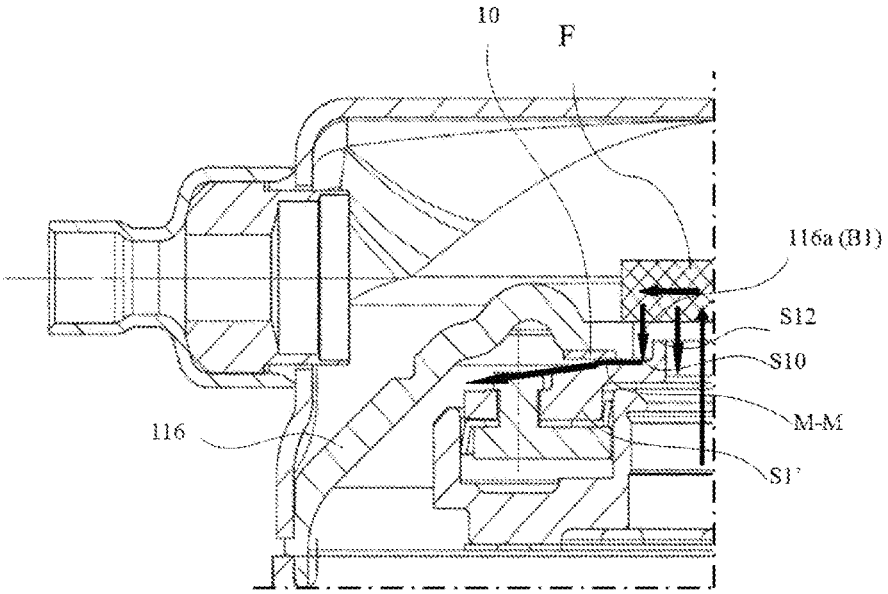
FIG. 3*c* is a partial sectional view of an improved form of the scroll compressor shown in FIG. 3*a*, which includes the upper plate of the sealing assembly shown in FIG. 3*b*, and a travel route of the lubricating oil in the exhaust gas is indicated by arrows.

FIG. 3*c* shows the structure after the upper plate S1 in the first embodiment is replaced with the upper plate S1'. The annular protruding portion S12 of the upper plate S1 is located on an inner side of the central hole 116*a* (equivalent to the central passage) of the partition plate 116, and the gap is left between an outer wall of the annular protruding portion S12 and an inner wall of the central hole 116*a*.

Through such an arrangement, a part of the lubricating oil filtered by the filter device F is allowed to drip into the gap between the annular protruding portion S12 and the wall surface of the central hole 116*a* of the partition plate 116, and then is received and stored by the groove S10 of the upper plate S1. It is conceivable that if the groove S10 is not provided, a part of the dripped lubricating oil will be stored in an annular groove between the annular protruding portion S12 and the wall surface of the central hole 116*a* of the partition plate 116. As such, a space between the annular protruding portion S12 and the wall surface of the central hole 116*a* of the partition plate 116 is functioned as an oil storage groove.

Depositing a part of the lubricating oil in the oil storage groove may bring a variety of beneficial effects. Firstly, an additional oil sealing effect is brought for the metal-metal sealing portion M-M, especially in a case that the metal-metal sealing portion M-M has poorly sealed parts due to deformation for example, the accumulated lubricating oil may improve the sealing effect of these poorly sealed parts. Secondly, when the scroll assembly shakes slightly during operation, the metal-metal sealing portion M-M may have a small gap due to relative movement (especially in a longitudinal direction), and a part of the lubricating oil stored in the oil storage groove is squeezed out of the metal-metal sealing portion M-M through the small gap under the pressure difference between the high-pressure side and the low-pressure side, and then flows back to the low-pressure side and flows back to an oil pool at the bottom of the compressor. Thirdly, if the oil amount of the oil storage groove exceeds the capacity of the oil storage groove, the excess oil can overflow outside the annular protruding portion S12 and flow back to the interior of the scroll. In FIG. 3*c*, in order to facilitate understanding, the flow path of the lubricating oil in the mixture is shown by arrows.

In other words, the sealed-oil interception structure is used, and the filter device F is added at the central hole 116*a* of the partition plate and the upper plate of the sealing assembly S is simply improved, which is able to achieve the secondary separation of the lubricating oil/refrigerant mixture after compression so as to facilitate the management of the lubricating oil of the compressor. The intercepted oil is also allowed to flow back to the interior of the scroll or re-guide to the low-pressure oil pool side, and an additional oil seal is also provided for the metal-metal sealing portion M-M so as to reduce pressure leakage. Therefore, the operation stability and compression performance of the compressor are greatly improved.

In addition, in the foregoing embodiment, the wear-resistant gasket 10 located at the bottom of the partition plate 116 is provided to directly contact the upper plate S1 or the upper plate S1' of the sealing assembly S, so as to form an air-tight seal. In this way, since the direct contact between the partition plate 116 and the sealing assembly S is avoided, the requirement of the partition plate 116 on the wear resistance of the material is reduced, and the material cost is saved. However, it is apparently to those skilled in the art that, the wear-resistant gasket 10 may also be omitted, so that the partition plate 116 is in direct contact with the upper plate S1 of the sealing assembly S to form a seal.

It should be noted here that, in addition to the filter device in a form of filter screen which can be used as the oil interception device according to the preset application, other suitable devices that can intercept and separate the oil particles in the exhaust gas can also be used, such as a guide plate, a rotary cylinder or other feasible oil-gas separator. In the case of including the filter screen, the material of the filter screen may be any suitable material, for example, any textile fiber screen or a hardware filter screen with multi-layer structure or a combination thereof.

In some practical applications, an additional element may be provided on the partition plate 116 to provide improved performance. The additional element may be mounted at the central hole 116*a* of the partition plate 116 and form a sealing fit with the central hole 116*a* and provide a wear-resistant first sealing surface M1. For ease of description, hereinafter, a combination of the partition plate 116 and the structure (for example, the wear-resistant gasket 10 described above) mounted at the partition plate 116 for providing the first sealing surface M1 will be referred to simply as "partition plate unit B". In addition, the above additional element will be collectively referred as "additional device", which may be, for example, a separate sealing ring, or a functional assembly with a sealing flange.

Figure 4A:
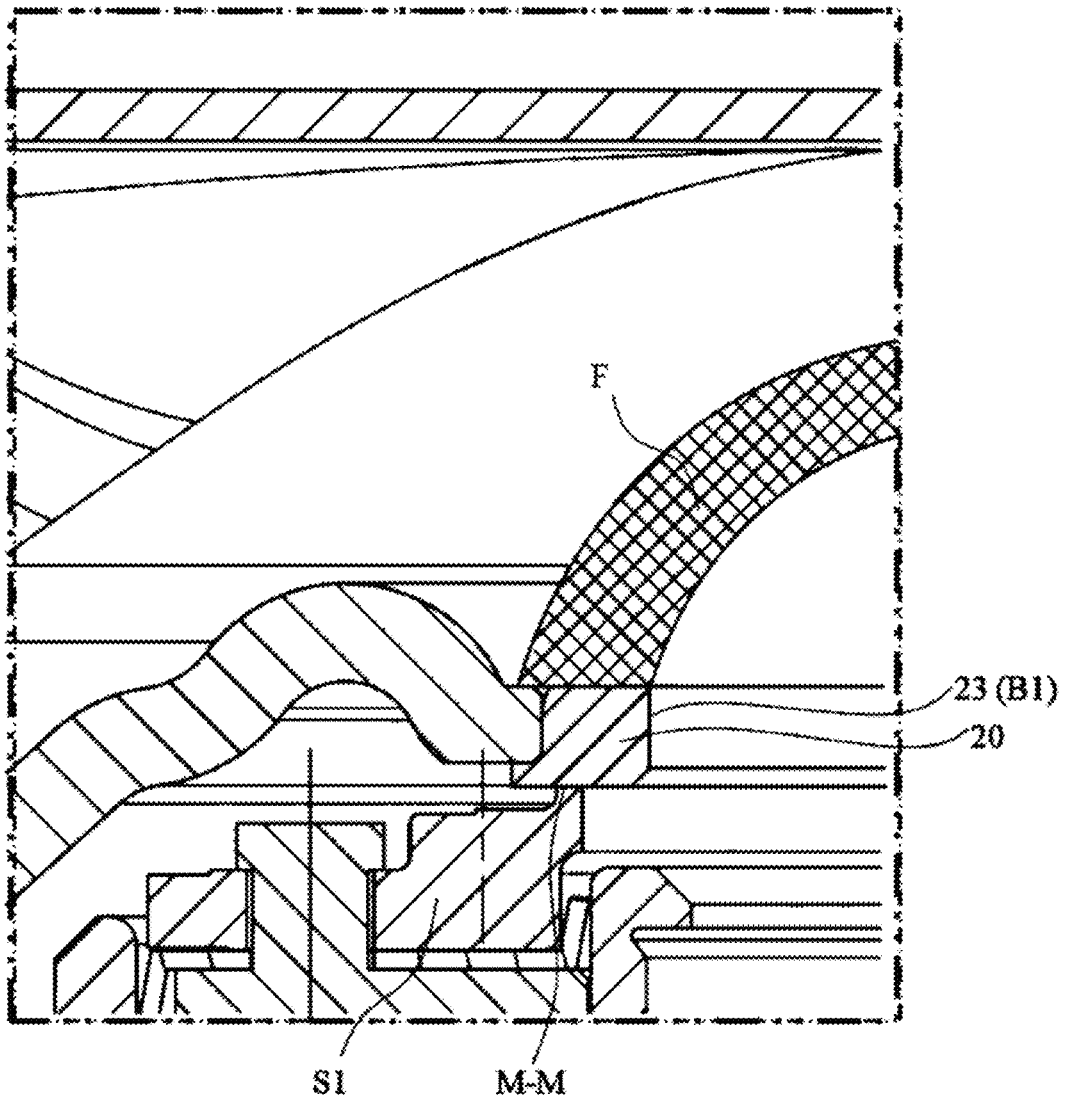
FIG. 4*a* is a partial sectional view of the scroll compressor according to a second embodiment of the present application.

As an example, in the second embodiment shown in FIG. 4*a*, the partition plate unit B includes a partition plate 116 and a sealing ring 20 (corresponding to the additional device) fitted in the central hole 116*a* of the partition plate 116, and an outer peripheral surface of the sealing ring 20 forms an interference fit with the central hole 116*a* so as to provide a good air-tight seal. In this case, an central orifice 23 of sealing ring 20 defines an exhaust hole B1 (which is also equivalent to the central passage) of the partition plate unit B, and a lower surface of the sealing ring 20 provides a first sealing surface M1 which is matched with the second sealing surface M2 of the upper plate S1 of the sealing assembly S. The filter device F with a dome shape is mounted on the sealing ring 20 and covers the central orifice 23 of the sealing ring 20, so as to filter the lubricating oil in the gaseous mixture discharged from the central orifice 23. The filter device F with the dome shape herein is only used as an example, which is intended to illustrate that the shape of the filter device F may be changed according to actual needs, and is not limited to the flat plate shape in the first embodiment. In this structure, a part of the intercepted oil may directly pass through the central orifice 23 of the sealing ring 20 and drop back to the interior of the scroll, while a part of the oil may converge to a bottom of the filter device F and flow back to the interior of the scroll along an inner wall of the central orifice 23.

Figure 4B:
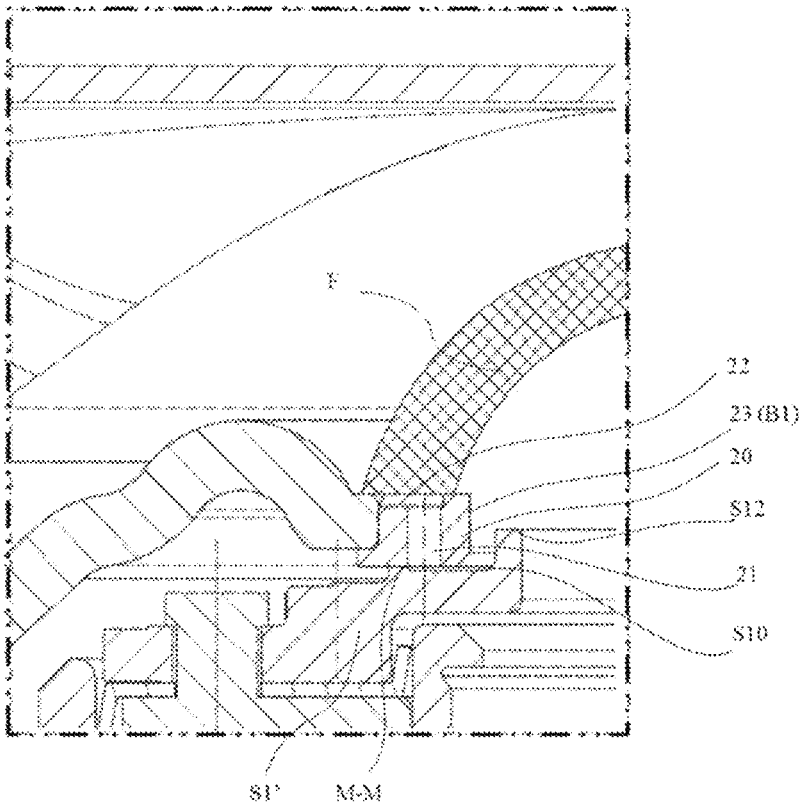
FIG. 4*b* is a partial sectional view of an improved form of the scroll compressor shown in FIG. 4*a*, which includes the upper plate of the sealing assembly shown in FIG. 3*b;*

In this embodiment, it is beneficial to replace the upper plate S1 of the sealing assembly S with the upper plate S1' as shown in FIG. 3*b*. As shown in FIG. 4*b*, the annular protruding portion S12 of the upper plate S1' is located on a radially inner side of the central orifice 23 (that is, the central passage) of the sealing ring 20 and has a gap with a wall surface of the central orifice 23, so that the lubricating oil filtered by the filter device F is allowed to drip into the gap between the annular protruding portion S12 and the wall surface of the central orifice 23 and is received and stored by the groove S10, which allows the lubricating oil to flow through the sealing portion M-M or overflow outside the annular protruding portion S12 so as to achieve the effect as can be provided in the first embodiment. Due to the use of the filter device F with the dome shape herein, the filtered lubricating oil may converge toward the bottom to a greater extent and enter the oil storage groove. Those skilled in the art are able to conceive easily that in addition to the dome shape, conical shape or other advantageous shapes may also be used to achieve this object.

On this basis, in order to promote the entry of the lubricating oil in the filter device F into the oil storage groove, the sealing ring 20 can be further improved. For example, as shown in FIG. 4*b*, a flange of the sealing ring 20 is provided with an oil hole 21 communicated with the groove S10 of the upper plate S1'. The oil hole 21 is located at a lower edge of the filter device F and can just receive the lubricating oil flowing downward from the filter device F. In an assembled state, the oil hole 21 is located on a radially inner side of the metal-metal sealing portion M-M. More advantageously, an upper surface of the flange of the sealing ring 20 may also be provided with an oil guide groove 22, which is convenient for receiving the lubricating oil dripping from the filter device F and guiding the lubricating oil into the oil hole 21 and then reaching the oil storage groove S10 of the upper plate S1'. However, it is conceivable that if the groove S10 is not provided at the top end of the upper plate S1', the annular groove between the annular protruding portion S12 of the upper plate S1' and the wall surface of the central orifice 23 (that is, the central passage) may be functioned as an oil storage groove, and a part of oil may also be stored in the oil hole 21. The oil in the oil hole 21 can also play the role of providing additional oil seal for the metal sealing portion M-M. In a case that a radial gap is generated between the first sealing surface M1 and the second sealing surface M2, the oil hole 21 is in communication with the annular groove, and at least a part of the oil received by the oil hole 21 and the annular groove may flow and mix on the second sealing surface M2, a part of the oil may flow into the low-pressure side, and another part of the oil may remain in the oil hole 21 or the annular groove.

Preferably, in the assembled state, the bottom of the filter device F, the oil guide groove 22, the oil hole 21 and the groove S10 are aligned as much as possible in a vertical direction so as to effectively receive and guide the filtered lubricating oil to the oil storage groove. Optionally, one or more oil holes 21 may be provided, and the position and the number of the oil guide groove 22 may correspond to the position and the number of the oil hole 21, or the oil guide groove 22 may be a single annular groove communicating the oil holes 21.

Figure 5A:
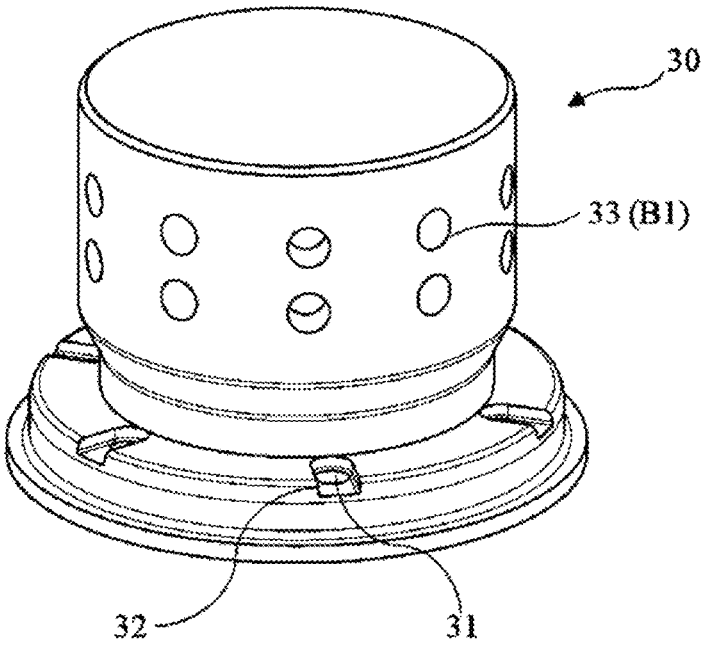
FIG. 5*a* is a perspective view of a silencer assembly applied in a third embodiment of the present application.
Figure 5B:
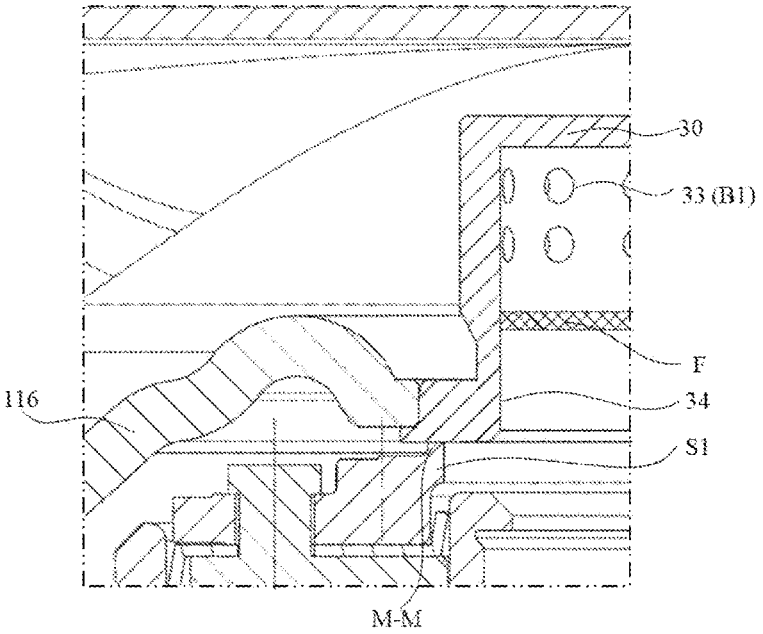
FIG. 5*b* is a partial sectional view of the scroll compressor according to the third embodiment of the present application.

FIGS. 5*a* to 5*e* show another possible form of the sealed-oil interception structure according to the present application. In this third embodiment, the partition plate unit B is provided with a cylindrical body formed integrally or separately with a sealing ring (for example, the sealing ring 20). In other words, in this embodiment, the additional device is no longer a separate sealing ring 20, but a silencer assembly (a wear-resistant element) 30 composed of a sealing flange (equivalent to the sealing ring) and the cylindrical body. The flange of the silencer assembly is tightly fitted in the central hole 116*a* and provides a first sealing surface M1 and a central orifice 34. As such, the central orifice 34 and an internal passage of the cylindrical body constitute the central passage of the partition plate unit B together. FIG. 5*a* shows a schematic diagram of the silencer assembly 30. In practical application, arranging the silencer assembly at the central hole 116*a* is beneficial to reducing the exhaust noise of the compressor. As shown in the figure, a top of the silencer assembly 30 is closed, and only has multiple exhaust holes 33 distributed on a side surface and functioned as exhaust holes B1 of the partition plate unit B. Therefore, as an optional mounting method shown in FIG. 5*b*, the filter device F may be mounted at the central orifice 34 of the silencer assembly 30, to completely or partially cover the central orifice 34, so as to intercept the lubricating oil in the exhaust gas to be passed through the multiple exhaust holes 33.

In addition, it is conceivable that on this basis, the upper plate S1 of the sealing assembly S may be replaced with the upper plate S1' as shown in FIG. 3*b*. In the assembled state (not shown), the annular protruding portion S12 of the upper plate S1' is located on a radially inner side of the central orifice 34 of the silencer assembly 30 and has a gap with a wall surface of the central orifice 34, so that the lubricating oil filtered is allowed to drip and be stored between the annular protruding portion S12 and the wall surface of the central orifice 23, so as to produce the technical effect as can be achieved in the first embodiment. Similarly, in this case, it is conceivable to arrange the filter device F into a configuration that the middle is high and the periphery is low, such as the dome shape or the conical shape, so as to facilitate the filtered oil to flow around in the filter device F and then to be collected more.

Figure 5C:
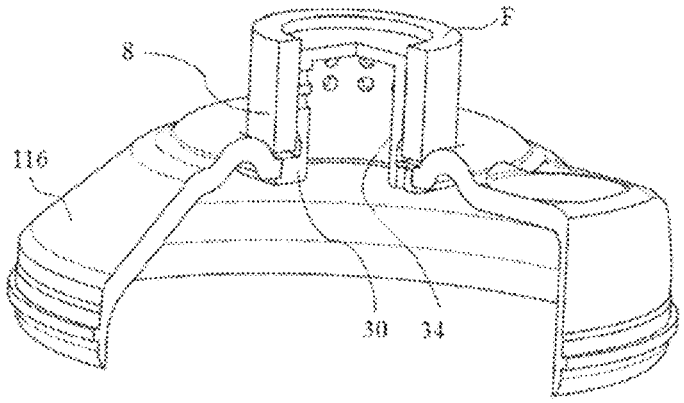
FIG. 5*c* is a perspective sectional view showing another combination of a partition plate unit and a filter device according to the third embodiment of the present application.
Figure 5D:
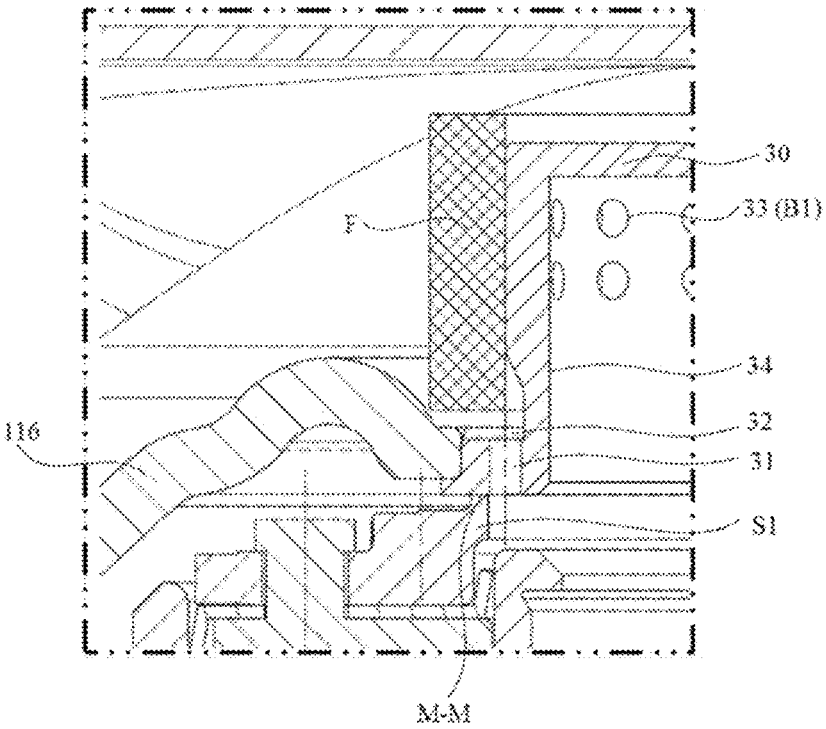
FIG. 5*d* is a partial sectional view of the scroll compressor including the partition plate unit and the filter device in FIG. 5*c;*
Figure 5E:
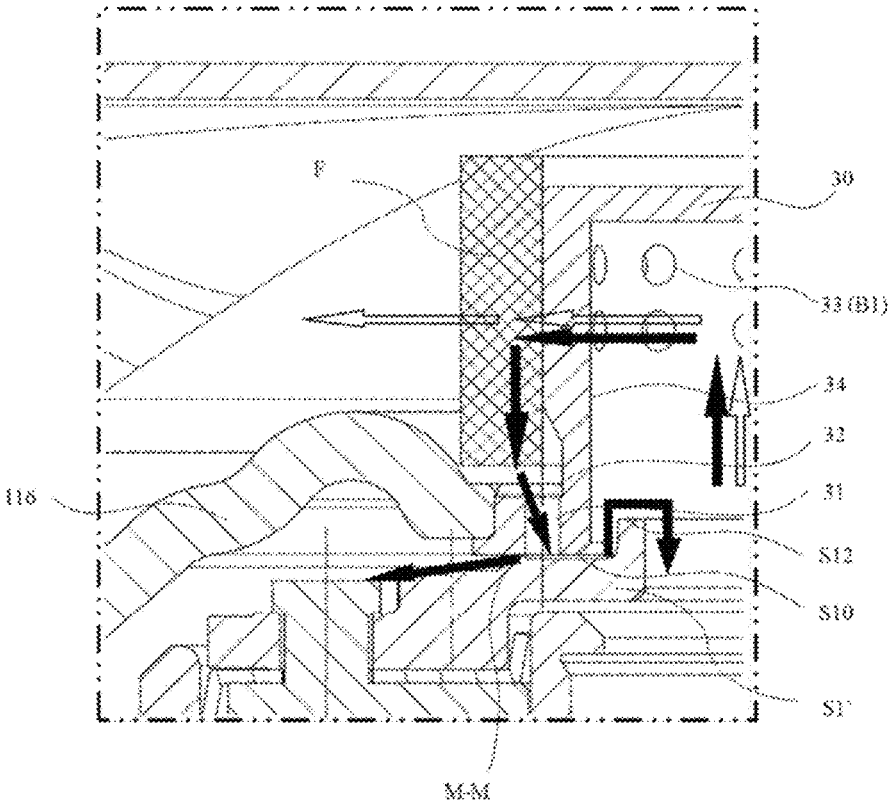
FIG. 5*e* is a partial sectional view of an improved form of the scroll compressor shown in FIG. 5*d*, which includes the upper plate of the sealing assembly shown in FIG. 3*b*, and a travel route of the lubricating oil in the exhaust gas is indicated by arrows.

FIGS. 5*c* to 5*e* show another alternative mounting method of the filter device F. As shown in FIG. 5*c*, the filter device F no longer surrounds the entire silencer assembly, but is adapted to be cylindrically mounted on the flange of the silencer assembly 30 and only surrounds the exhaust hole 33 on the side wall. FIG. 5*d* shows an assembled state diagram. In this embodiment, an oil hole 31 arranged on the flange of the silencer assembly 30 is required to be provided, so as to provide a path for the lubricating oil in the filter device F to flow back to the interior of the scroll.

As shown in FIG. 5*e*, if the upper plate S1 of the sealing assembly S is replaced with the upper plate S1' as shown in FIG. 3*b*, in the assembled state, the oil hole 31 is located on a radially inner side of the metal-metal sealing portion M-M. The oil hole 31 will provide a path to merge into the oil storage groove, and flow paths of the gas and the lubricating oil in the mixture are also shown by hollow arrows and solid arrows respectively in FIG. 5*e*. In addition, FIG. 5*e* further shows an oil guide groove 32 arranged corresponding to the oil hole 31. As described above, the oil guide groove 32 is not necessary, and the arrangement of the oil hole 31 and the oil guide groove 32 may have various alternative forms and is not limited to what is shown here.

In addition, although in the drawings of the present application, the oil holes 21 and 31 are shown in the form of cylindrical through holes, those skilled in the art can easily conceive various modifications in different forms. For example, in order to collect and guide the lubricating oil better, the oil hole may have an inverted conical shape, or a configuration with an inverted conical flared portion on an upper portion and a cylindrical shape on a lower portion. Such configuration of the oil hole is advantageous in the case of not providing an oil guide groove.

In this embodiment, the flange of the silencer assembly 30 acts as the so-called wear-resistant element of the first sealing surface M1.

In particular, it is apparent to those skilled in the art that the configuration of the filter device may be designed in an advantageous manner according to the configuration of the partition plate unit, as long as the filter device can achieve effective filtration of the mixed gas discharged from the partition plate unit, and is not be limited to the configurations given in the embodiments herein.

Figure 6A:
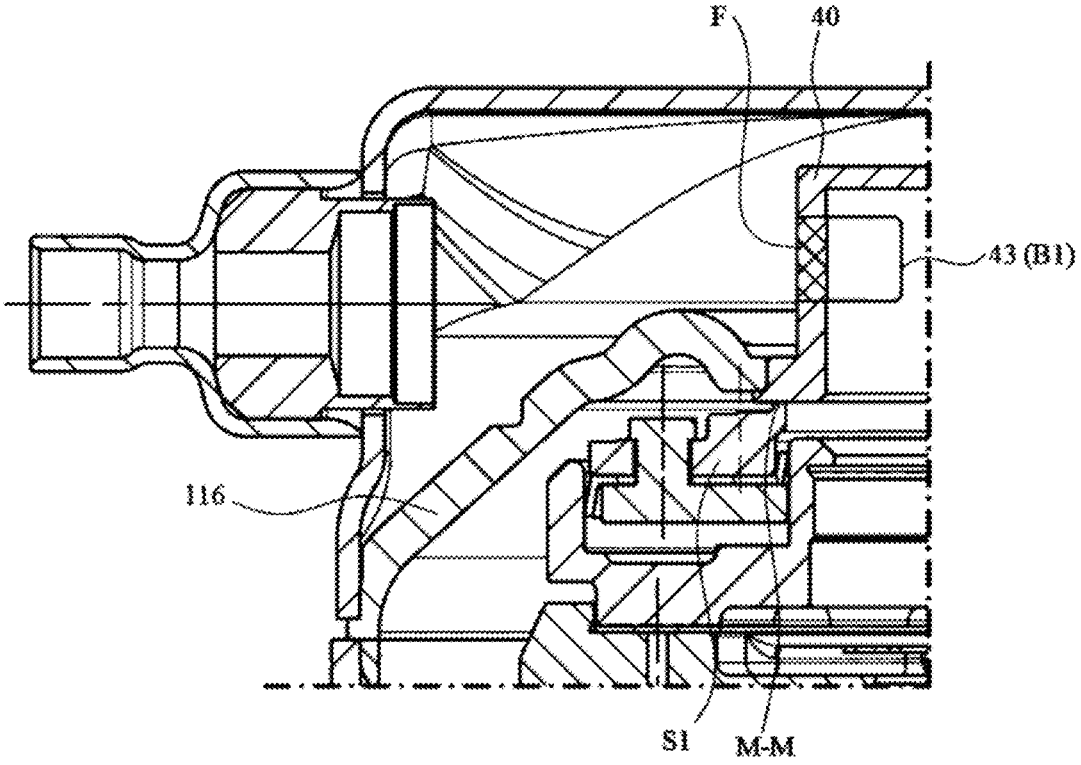
FIG. 6*a* is a partial sectional view of the scroll compressor including a sealed-oil interception structure according to a fourth embodiment of the present application.

Further, the filter device F may also have a split structure. As an example, FIG. 6*a* shows a fourth embodiment of the sealed-oil interception structure. In this embodiment, for the additional device, the silencer assembly 30 is replaced by a cylindrical assembly 40 with at least one side hole 43. However, a cylindrical portion in the cylindrical assembly 40 may also be other members with a side hole, for example, which may be a bracket formed by a frame for supporting the filter screen, or any devices (including but not limited to the above silencer cover) with other additional functions. In this embodiment, the filter device F is no longer completely surrounded outside the central hole 116*a*, but is directly mounted in the corresponding side hole 43 in a form of multiple independent individuals. The advantage of the filter device F with the split structure is apparent. For example, the filter material can be saved, and the production cost can be reduced. When a filter element in one place needs to be repaired or replaced, only this filter element is maintained or replaced, so as to reduce the cost of renewal and maintenance.

In this embodiment, a part of the lubricating oil intercepted by the filter device F can flow downward along an inner wall of the cylindrical portion and return to the interior of the scroll. Further, it is conceivable that in order to facilitate guiding the lubricating oil in the filter device F to return to the interior of the scroll to a greater extent, at least one oil hole 41 may be arranged at the a bottom flange of the cylindrical assembly 40, and the number and the position of the oil hole 41 are preferably corresponded to the number and the position of the side hole 43. In the assembled state, the oil hole 21 is located on the radially inner side of the metal-metal sealing portion M-M, which allows a part of the oil intercepted by the filter device F to flow downward along an outer wall of the cylindrical portion and return to the interior of the scroll.

Figure 6B:
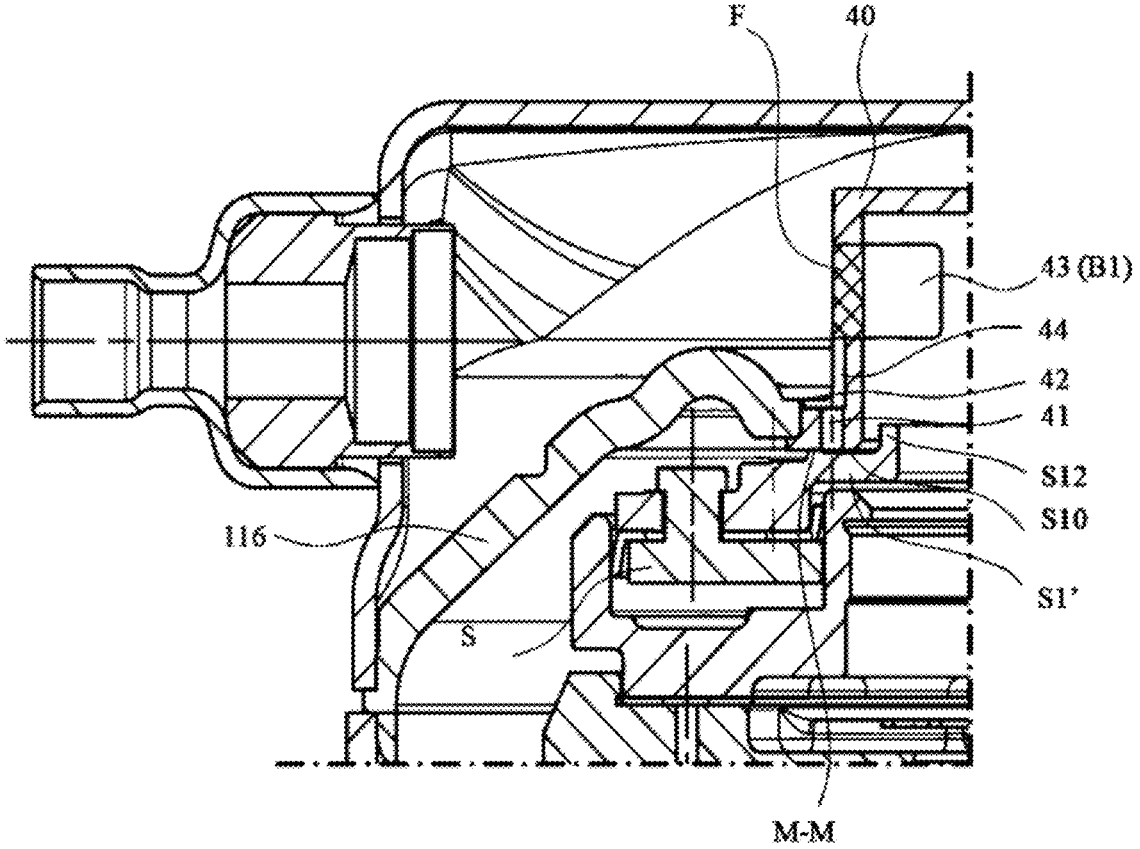
FIG. 6*b* is a partial sectional view of an improved form of the scroll compressor shown in FIG. 6*a*, which includes the upper plate of the sealing assembly shown in FIG. 3*b*.

If the upper plate S1 of the sealing assembly S is replaced with the upper plate S1' as shown in FIG. 3*b*, in this case, a part of oil intercepted by the filter device F is allowed to be guided to the low-pressure side. In order to guide the lubricating oil in the filter device F to the oil hole 41 and the oil storage groove better, at least one vertical guide groove 44 communicated with the oil hole 41 may be arranged below the side hole 43 on which the filter device F is mounted, and the improved form is shown in FIG. 6*b*.

It is also be understood by those skilled in the art that although the oil hole and the oil guide groove are simultaneously provided in this exemplary embodiment, the oil guide groove is not an absolutely necessary structure, and may be omitted under appropriate circumstances, or may be replaced by other structure suitable for guiding the oil to the oil hole.

Although various embodiments and modifications of the present application have been described in detail herein, it should be understood by those skilled in the art that the present application is not limited to the above specific embodiments and modifications, but may include various other possible combinations and bindings, and other variations and modifications may be realized by those skilled in the art without departing from the spirit and scope of the present application. All these modifications and variations fall within the scope of the present application. Moreover, all the members described herein can be replaced by other technically equivalent members.

The invention claimed is:

1. A scroll compressor comprising:

a partition plate unit, wherein the partition plate unit has an exhaust hole for allowing exhaust gas to pass therethrough and a first sealing surface located on a bottom side of the partition plate unit; and a sealing assembly, wherein the sealing assembly is arranged below the partition plate unit, and the sealing assembly comprises at its top end a second sealing surface configured to surround a central hole of the sealing assembly, and the second sealing surface abuts against the first sealing surface so that a sealing portion is formed which separates a high-pressure side and a low-pressure side, wherein, the scroll compressor further comprises an oil interception device arranged at the exhaust hole of the partition plate unit to intercept oil in the exhaust gas and allow the intercepted oil to flow back through the partition plate unit, and wherein the top end of the sealing assembly extends inward radially beyond a wall surface of a central passage of the partition plate unit, and an inner edge of the top end is provided with a protruding portion protruding upward on a radially inner side of the wall surface of the central passage of the partition plate unit, wherein a gap is left between the protruding portion and the wall surface of the central passage to receive at least a part of the oil dripping from the oil interception device.

2. The scroll compressor according to claim 1, wherein the partition plate unit comprises a partition plate defining the exhaust hole and a wear-resistant gasket provided on a bottom side of the partition plate and around the exhaust hole, and a bottom surface of the wear-resistant gasket provides the first sealing surface.

3. The scroll compressor according to claim 1, wherein the partition plate unit comprises a partition plate having a central hole and an additional device mounted in the central hole of the partition plate, and the additional device defines the exhaust hole of the partition plate unit and the first sealing surface.

4. The scroll compressor according to claim 3, wherein the additional device is a sealing ring, a central orifice of the sealing ring defines the exhaust hole of the partition plate unit, and a bottom surface of the sealing ring provides the first sealing surface.

5. The scroll compressor according to claim 4, wherein at least one oil hole is provided in the sealing ring, the number and the position of the oil hole are set to be suitable for receiving the oil from the oil interception device, and the oil hole is positioned to be located on a radially inner side of the sealing portion in an assembled state.

6. The scroll compressor according to claim 5, wherein the oil hole is a cylindrical through hole, an inverted conical through hole or a through hole with a flared portion at an upper end.

7. The scroll compressor according to claim 5, wherein an oil guide groove is provided on the sealing ring, and the oil guide groove is located above the oil hole for receiving the oil dripping from the oil interception device and guiding the oil into the oil hole.

8. The scroll compressor according to claim 5, wherein the top end of the sealing assembly is provided with a groove located between the second sealing surface and the protruding portion, and the groove is located below the oil hole in the assembled state to receive the oil from the oil hole and the gap.

9. The scroll compressor according to claim 3, wherein the additional device comprises a sealing ring and a cylindrical body formed integrally or separately with the sealing ring, the cylindrical body extends upward around a central orifice of the sealing ring, and the cylindrical body is provided with at least one hole serving as the exhaust hole of the partition plate unit, and a bottom surface of the sealing ring provides the first sealing surface.

10. The scroll compressor according to claim 9, wherein the oil interception device is arranged in the cylindrical body in a manner of crossing an inner diameter of the cylindrical body to intercept the oil in the exhaust gas to be discharged through the at least one hole at the cylindrical body.

11. The scroll compressor according to claim 9, wherein the oil interception device integrally surrounds an outer side of the cylindrical body above the sealing ring.

12. The scroll compressor according to claim 9, wherein the at least one hole is provided at a side wall of the cylindrical body.

13. The scroll compressor according to claim 12, wherein the oil interception device is in a split form and separately arranged in the at least one hole on the cylindrical body.

14. The scroll compressor according to claim 9, wherein the cylindrical body is configured as a silencer cover suitable for reducing exhaust noise.

15. The scroll compressor according to claim 1, wherein the oil interception device is a filter device with a filter screen.

16. The scroll compressor according to claim 15, wherein the filter device is an integrated filter device, and the filter device is able to be adapted to have a flat plate shape, a dome shape, a conical shape or a topped cylindrical shape according to the arrangement of the exhaust hole of the partition plate unit.

17. The scroll compressor according to claim 1, wherein the sealing assembly is a floating sealing ring assembly arranged in a recess portion at a fixed scroll end plate of the scroll compressor, and the top end is provided by an upper plate of the floating sealing ring assembly.

18. The scroll compressor according to claim 1, wherein the first sealing surface and the second sealing surface form a metal-metal seal.

* * * * *